US008413775B2

(12) United States Patent
Tong

(10) Patent No.: US 8,413,775 B2
(45) Date of Patent: Apr. 9, 2013

(54) COLLAPSIBLE WHEEL STRUCTURE FOR A LUGGAGE BOX

(76) Inventor: Joy Tong, Boca Raton, FL (US)

( * ) Notice: Subject to any disclaimer, the term of this patent is extended or adjusted under 35 U.S.C. 154(b) by 341 days.

(21) Appl. No.: 12/836,937

(22) Filed: Jul. 15, 2010

(65) Prior Publication Data

US 2012/0012430 A1 Jan. 19, 2012

(51) Int. Cl.
*A45C 5/14* (2006.01)

(52) U.S. Cl. ..... 190/18 R; 190/107

(58) Field of Classification Search ..... 190/18 R, 190/107

See application file for complete search history.

(56) References Cited

U.S. PATENT DOCUMENTS

| | | | | |
|---|---|---|---|---|
| 6,179,101 | B1 * | 1/2001 | Lin | 190/103 |
| 6,267,393 | B1 * | 7/2001 | Mengrone et al. | 280/37 |
| 7,314,126 | B2 * | 1/2008 | Godshaw et al. | 190/18 A |
| 7,849,984 | B2 * | 12/2010 | Whalen et al. | 190/18 A |
| 2004/0144606 | A1 * | 7/2004 | Han | 190/18 A |
| 2008/0135365 | A1 * | 6/2008 | Han | 190/107 |
| 2008/0245633 | A1 * | 10/2008 | Chun | 190/18 A |

* cited by examiner

*Primary Examiner* — Tri Mai
(74) *Attorney, Agent, or Firm* — Pai Patent & Trademark Law Firm; Chao-Chang David Pai

(57) ABSTRACT

A collapsible wheel structure for a luggage box includes a wheel base and a foldable rod. The wheel base is pivotally connected with a wheel. One end of the wheel base is pivotally connected to the foldable rod. The foldable rod is pivotally connected to the wheel base for connecting with the wheel base firmly. When the wheel base and the foldable rod are unlocked, the foldable rod is in a folded status. The collapsible wheel structure is adapted to couple with the bottom of the luggage box. When the foldable rod is in a folded status, the size of the luggage will be reduced.

5 Claims, 8 Drawing Sheets

COLLAPSIBLE WHEEL STRUCTURE FOR A LUGGAGE BOX

BACKGROUND OF THE INVENTION (a) Field of the Invention

The present invention relates to a collapsible wheel structure coupled to the bottom of a luggage box so as to compress the luggage box when folding, such that the size of the luggage box can be reduced.

(b) Description of the Prior Art

A conventional soft luggage box with rollers adopts a fixed way to connect its bottom and sides. When the luggage box is empty without any articles therein, the size of the luggage box cannot be changed. Whether the luggage box is empty or not makes no difference to the size of the luggage box. When the luggage box is not in use, the size of the luggage box can not be reduced. It is not convenient to store the luggage box which occupies storage space.

SUMMARY OF THE INVENTION

The present invention is to provide a collapsible wheel structure coupled to the bottom of a luggage box, which comprises a wheel base and a foldable rod. When the luggage box is in use, the foldable rod is unfolded. When the luggage box is not in use, the foldable rod is folded to compress the empty luggage box, such that the size of the luggage box can be reduced to save the space of storage.

DETAILED DESCRIPTION OF THE PREFERRED EMBODIMENTS

Embodiments of the present invention will now be described, by way of example only, with reference to the accompanying drawings.

Figure 1:
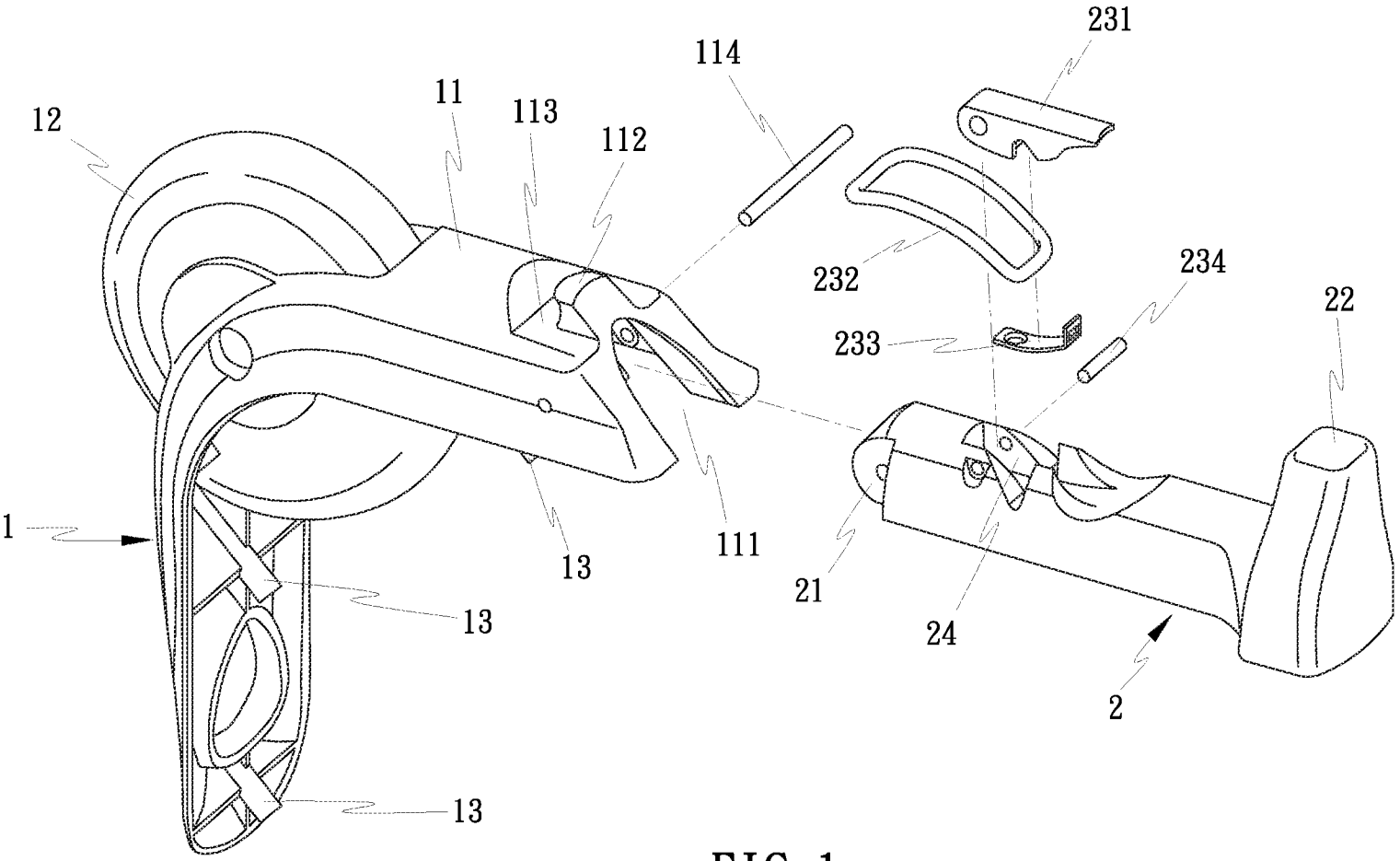
FIG. 1 is an exploded view according to a preferred embodiment of the present invention.

As shown in FIG. 1, a collapsible wheel structure for a luggage box according to a preferred embodiment of the present invention comprises a wheel base 1 and a foldable rod 2.

The wheel base 1 comprises an L-shaped support 11 and a wheel 12. The wheel 12 is pivotally connected to the support 11. The wheel base 1 has an opening 111 at one end thereof to connect with the foldable rod 2. The wheel base 1 has an outer side formed with a protrusion 112 and an engaging recess 113. A pin 114 penetrates the wheel base 1 to connect the wheel base 1 and the foldable rod 2 together.

Figure 2:
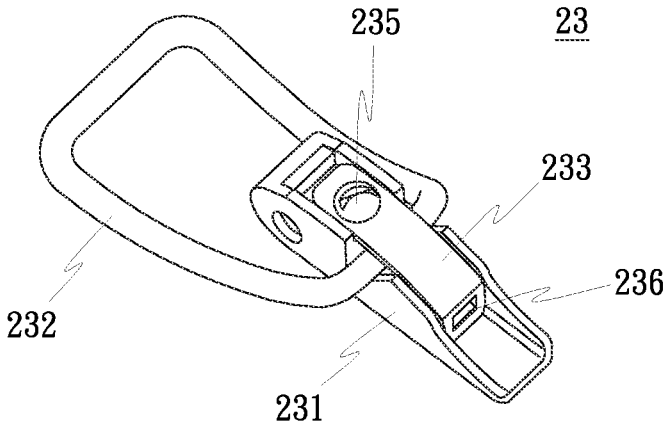
FIG. 2 is a perspective view of a buckle unit according to the preferred embodiment of the present invention.
Figure 3:
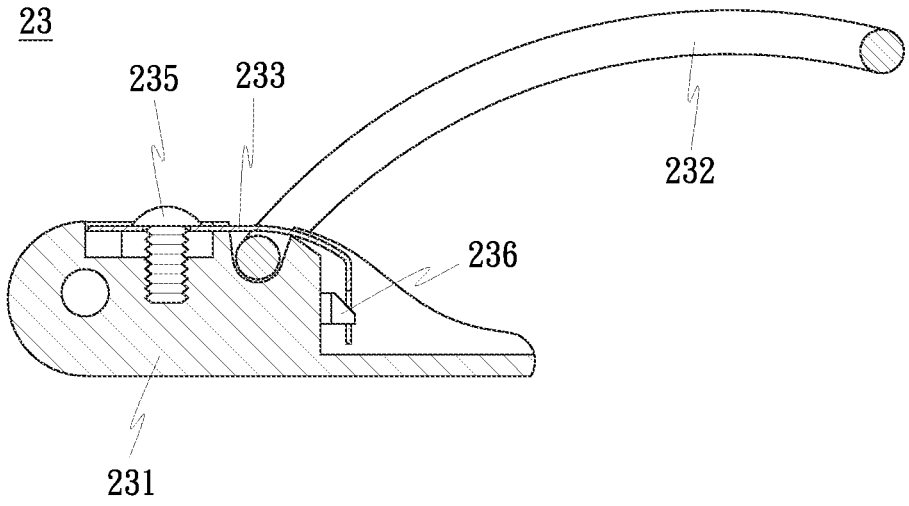
FIG. 3 is a cross-sectional view of the buckle unit according to the preferred embodiment of the present invention.
Figure 4:
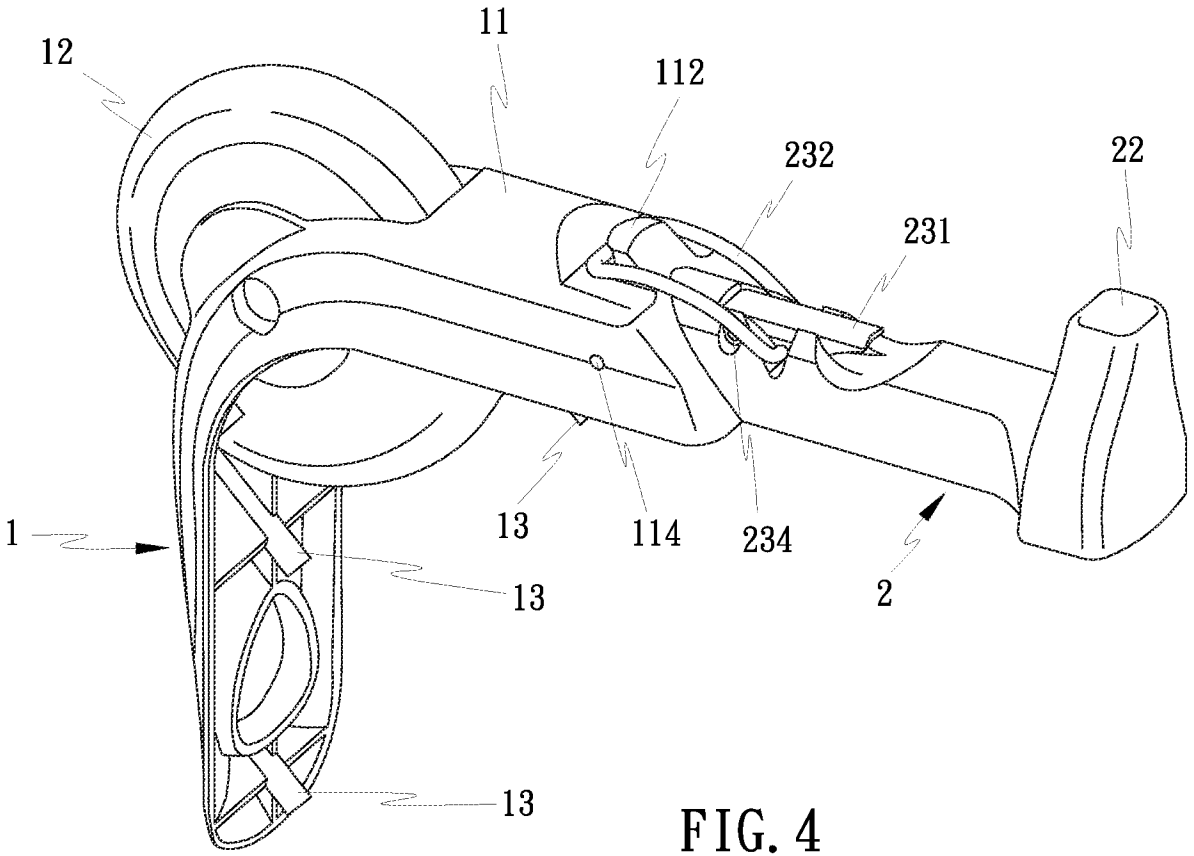
FIG. 4 is a perspective view of the preferred embodiment of the present invention in an unfolded status.
Figure 5:
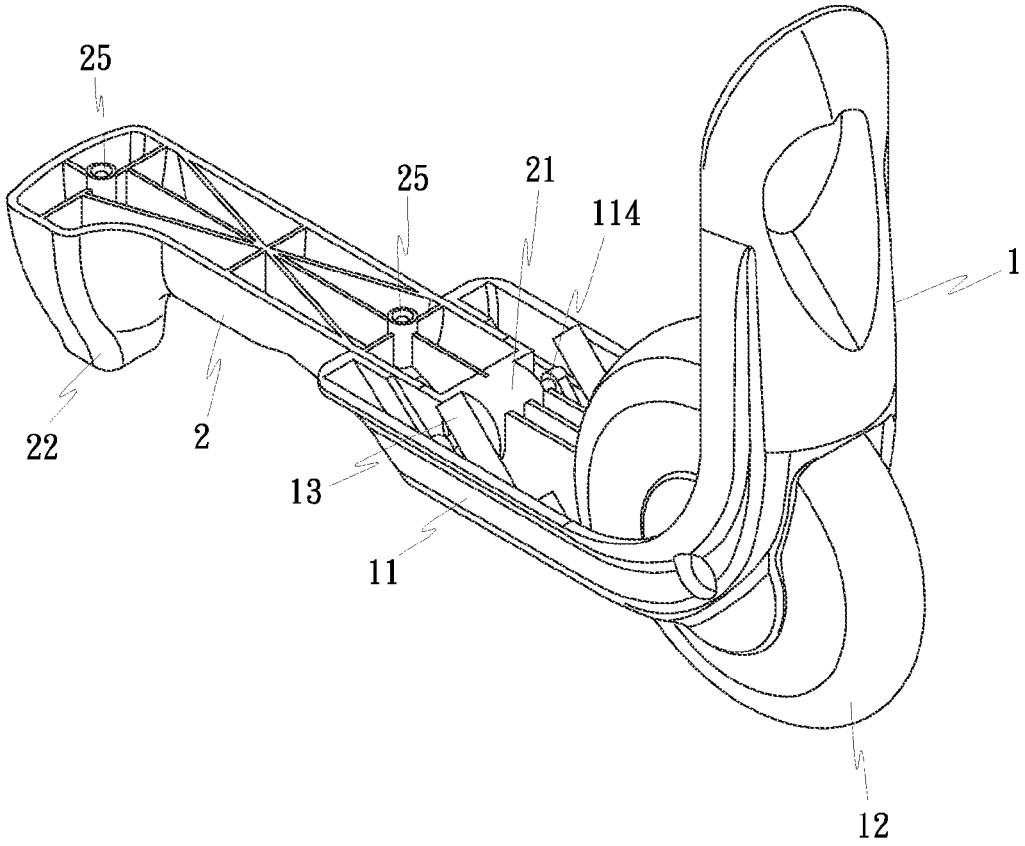
FIG. 5 is another perspective view of the preferred embodiment of the present invention in an unfolded status.
Figure 6:
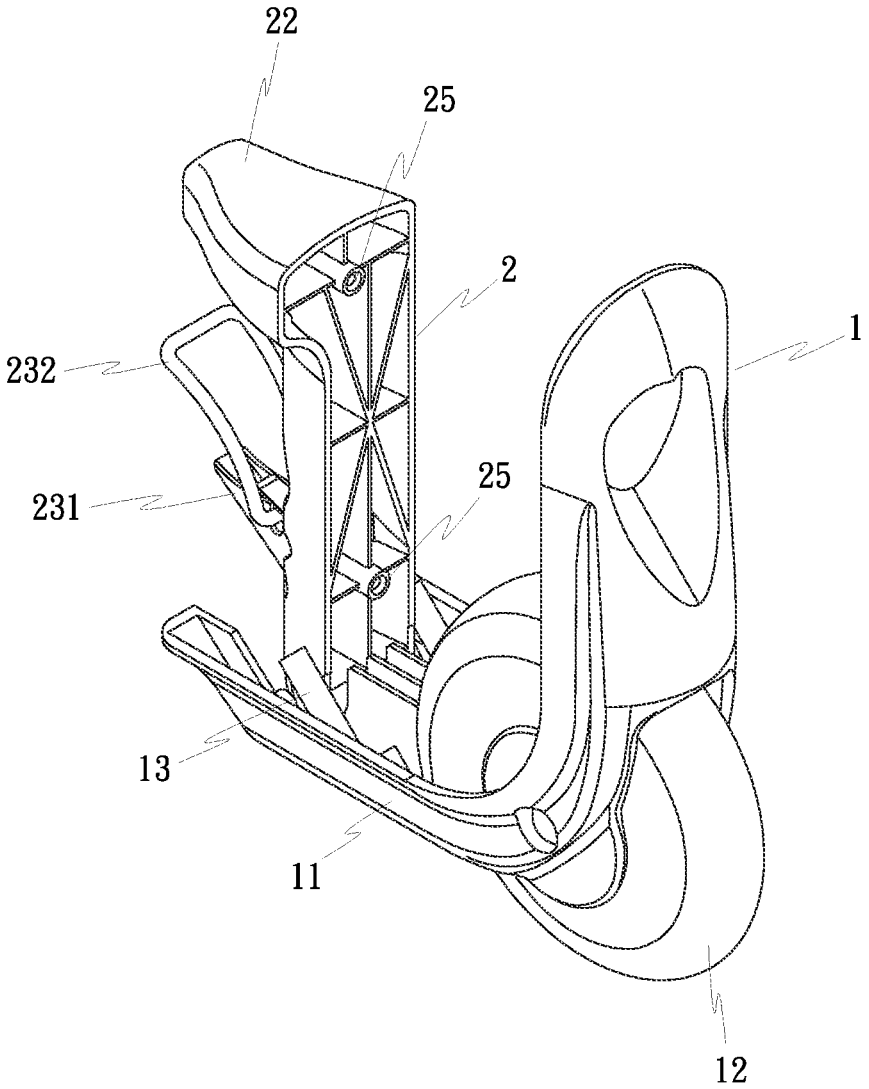
FIG. 6 is a perspective view of the preferred embodiment of the present invention in a folded status.
Figure 7:
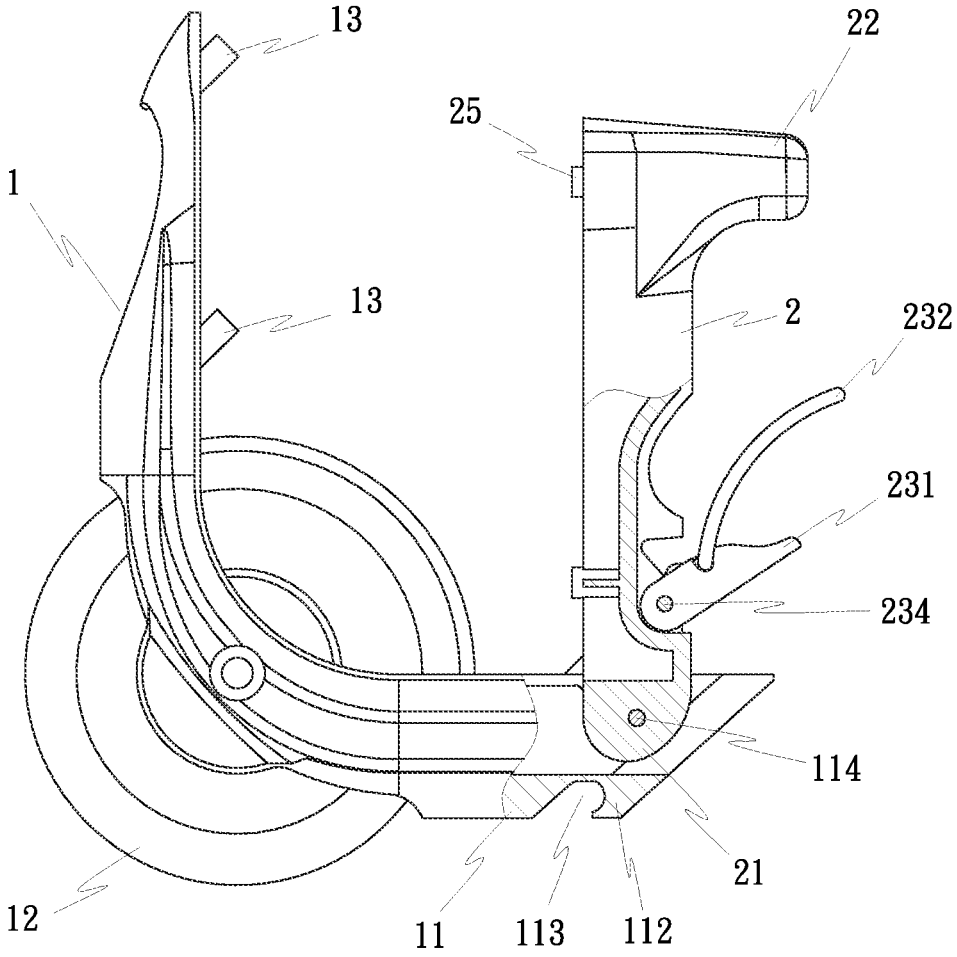
FIG. 7 is a cross-sectional view of the preferred embodiment of the present invention in a folded status.

The foldable rod 2 has a pivot portion 21 at one end thereof corresponding to the support 11 of the wheel base 1. The pin 114 is inserted through the pivot portion 21 to connect the wheel base 1 and the foldable rod 2 together. The foldable rod 2 further has a foot pad 22 at another end thereof. A buckle unit 23 is provided on an outer side of the foldable rod 2, as shown in FIG. 2 and FIG. 3. The buckle unit 23 comprises a buckle member 231, a loop 232, and a fixing plate 233. The foldable rod 2 has a concave trough 24 corresponding in position to the buckle unit 23, so that the buckle unit 23 can be received in the concave trough 24 and connected with a pin 234. By pulling the buckle member 231, the loop 232 is controlled to engage with or disengage from the engaging recess 113 of the support 11. As shown in FIG. 4 and FIG. 5, the wheel base 1 and the foldable rod 2 are in a locked status. As shown in FIG. 6 and FIG. 7, the wheel base 1 and the foldable rod 2 are in an unlocked status.

Figure 8:
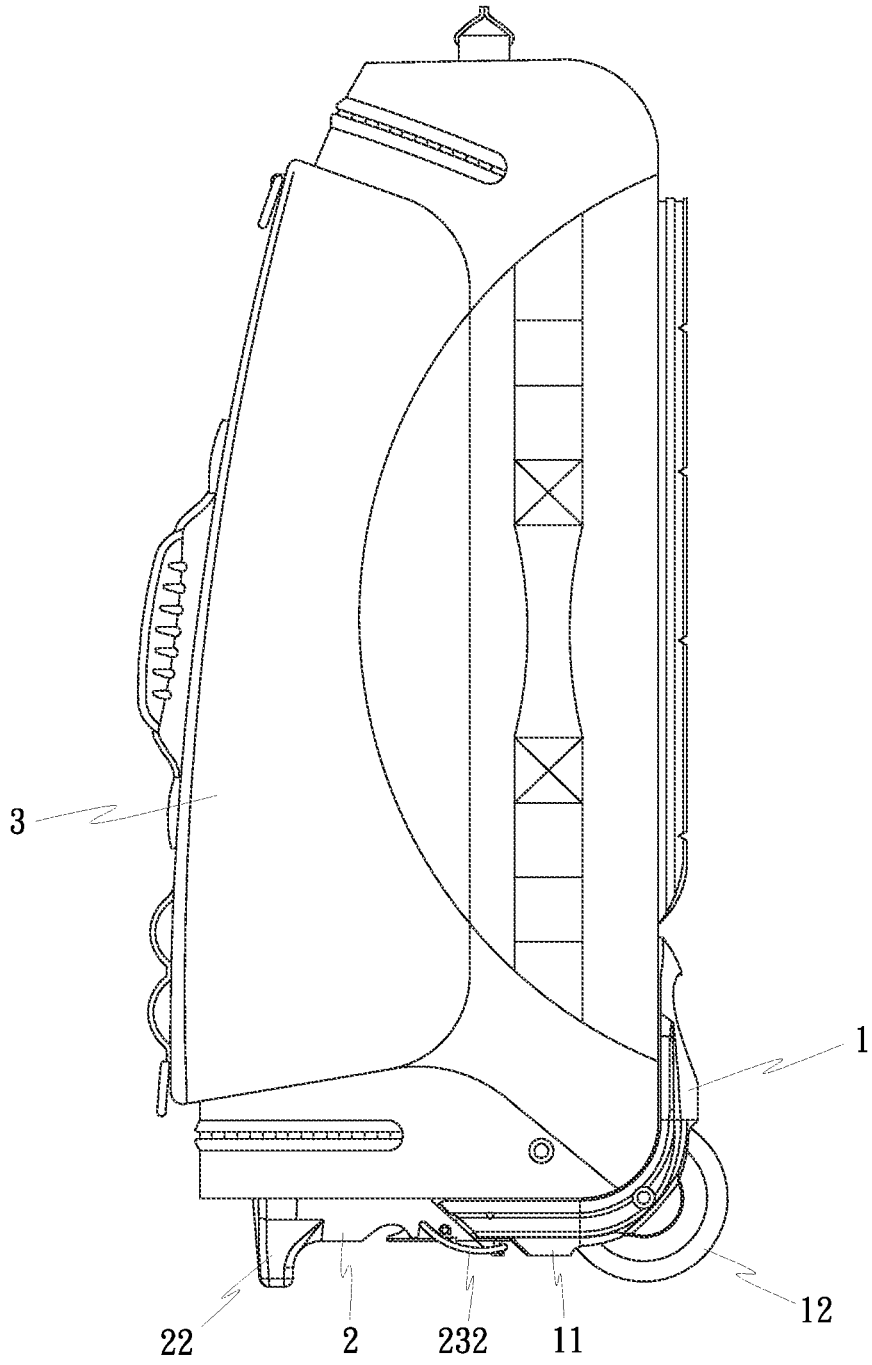
FIG. 8 is a perspective view of the preferred embodiment of the present invention coupled to the bottom of a soft bag of the luggage box.
Figure 9:
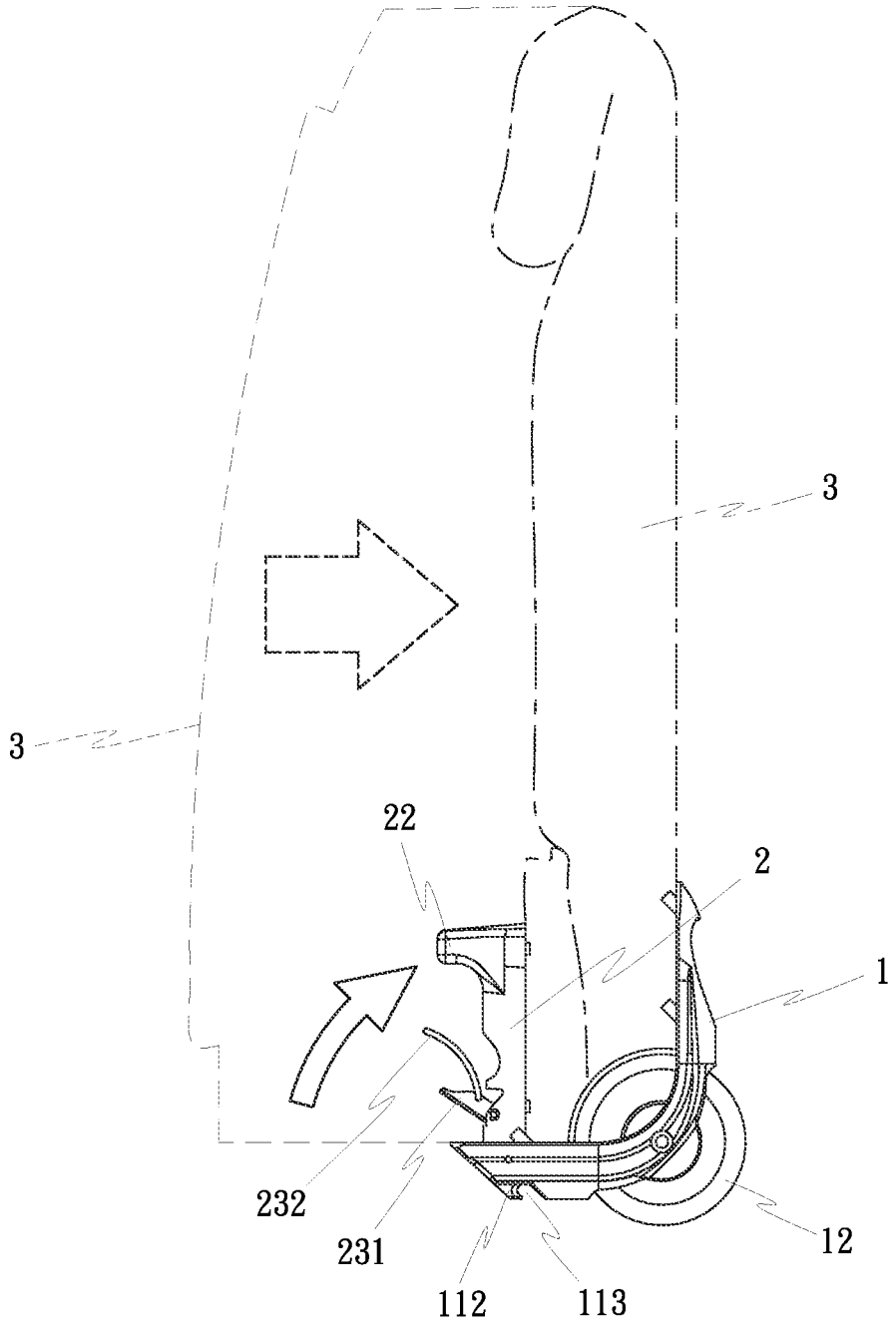
FIG. 9 is a schematic view showing the preferred embodiment of the present invention coupled to the luggage box in a folded status.

The collapsible wheel structure composed of the wheel base 1 and the foldable rod 2 can be coupled to the bottom of a soft bag 3, as shown in FIG. 8. When the luggage box is in use, the foldable rod 2 is unfolded to hold the bottom of the soft bag 3 of the luggage box. When the luggage box is not in use, the foldable rod 2 is folded to compress the soft bag 3 of the luggage box in a direction as designated by the arrow of FIG. 9. The size of the soft bag 3 is reduced to save the space of storage.

The loop 232 of the buckle unit 23 is secured between the fixing plate 233 and the buckle member 231. The fixing plate 233 is firmly connected to the buckle member 231 by means of a screw 235 and a protruding portion 236 of the buckle member 231, preventing the loop 232 from disengagement.

The buckle unit 23 on the foldable rod 2 is not to be limited as shown in the drawings and can be replaced with other buckle units which provide the same effect to lock or unlock the wheel base 1 and the foldable rod 2.

Furthermore, the wheel base 1 and the foldable rod 2 are provided with a plurality of coupling portions 13, 25 to couple with the bottom of the soft bag 3 of the luggage box. Besides, the size, length and shape of the wheel base 1 and the foldable rod 2 can be changed corresponding to the soft bag of the luggage box. The wheel base 1 and the foldable rod 2 can be solid or hollow. In this embodiment, the wheel base 1 is a hollow base provided with a plurality of reinforcement ribs to reinforce its strength.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A collapsible wheel structure for a luggage box, comprising a wheel base and a foldable rod, and characterized by:

the wheel base comprising a support and a wheel, the wheel being pivotally connected to the support, one end of the wheel base being pivotally connected to the foldable rod;

the foldable rod having a pivot portion which is pivotally connected to the support of the wheel base, the foldable rod being coupled with a buckle unit to control engagement and disengagement of the foldable rod and the wheel base, wherein the buckle unit comprises a buckle member, a loop and a fixing plate, the foldable rod has a concave trough corresponding in position to the buckle unit, the loop of the buckle unit is secured between the fixing plate and the buckle member, and the fixing plate is firmly connected to the buckle member with a screw and a protruding portion of the buckle member;

thereby, the collapsible wheel structure being coupled to a bottom of a soft bag of the luggage box, when the luggage box is in use, the foldable rod being unfolded to hold the bottom of the soft bag of the luggage box, when the luggage box is not in use, the foldable rod being folded to compress the soft bag of the luggage box so as to reduce the size of the soft bag.

2. The collapsible wheel structure for a luggage box as claimed in claim 1, wherein the support of the wheel base has an L shape.

3. The collapsible wheel structure for a luggage box as claimed in claim 1, wherein the wheel base has an outer side formed with a protrusion and an engaging recess, a pin penetrates the wheel base to connect the wheel base and the foldable rod.

4. The collapsible wheel structure for a luggage box as claimed in claim 1, wherein another end of the foldable rod is provided with a foot pad.

5. The collapsible wheel structure for a luggage box as claimed in claim 1, wherein the wheel base and the foldable rod are provided with a plurality of coupling portions.

* * * * *